United States Patent [19]

DeLorme

[11] Patent Number: 4,521,998

[45] Date of Patent: Jun. 11, 1985

[54] UNIVERSAL HUB FOR GEODESIC TYPE STRUCTURES

[76] Inventor: David M. DeLorme, 356 Range Rd., Cumberland, Me. 04021

[21] Appl. No.: 512,154

[22] Filed: Jul. 8, 1983

[51] Int. Cl.[3] ..... E04B 1/32; E04B 1/40

[52] U.S. Cl. ..... 52/81; 52/646; 403/64; 403/170

[58] Field of Search ..... 52/81, 646, 648, DIG. 10; 403/64, 170, 171, 174

[56] References Cited

U.S. PATENT DOCUMENTS

| | | | |
|---|---|---|---|
| 3,757,476 | 9/1973 | Schoen | 403/64 X |
| 3,771,274 | 11/1973 | Vaughan | 52/646 |
| 4,262,461 | 4/1981 | Johnson et al. | 52/646 |
| 4,277,922 | 7/1981 | McAllister | 52/81 |
| 4,355,918 | 10/1982 | Van Vliet | 52/81 |
| 4,450,851 | 5/1984 | Beavers | 403/64 |
| 4,464,073 | 8/1984 | Cherry | 403/170 |

FOREIGN PATENT DOCUMENTS

| | | | |
|---|---|---|---|
| 929862 | 6/1963 | United Kingdom | 52/81 |

*Primary Examiner*—J. Karl Bell

*Attorney, Agent, or Firm*—Daniel H. Kane, Jr.

[57] ABSTRACT

A new hub provides flexible or universal coupling for securing struts at the vertices of geodesic type grid or framework. Each hub is formed by a plurality of universal connectors securing adjacent pairs of converging struts forming a closed ring of universal connectors and converging struts at each vertex of the geodesic type spatial framework. Each connector includes a pair of hinge plates or faces positioned at the facing side surfaces of adjacent chords or struts converging at a vertex. Each hinge face is secured in parallel for rotation of the hinge face relative to the side surface of the strut during construction. The universal connectors are formed with hinge ears defining a hinge axis offset from the plane of the corresponding hinge face. Hinge ears from adjacent hinge faces of a universal connector overlap to define a common hinge axis. The universal connector is therefore a universal joint which may rotate in a first degree of freedom around the hinge axis and in second and third degrees of freedom about pivot points securing the hinge faces or plates at the facing side surfaces of adjacent struts. The geodesic type spatial framework may therefore depart from the mathematical or geometrical regularity associated with traditional geodesic domes. The framework is in the form of a grid of triangle patterns which may all differ as may also differ the converging angles, articulating angles, and lengths of the chords or struts. The framework of an irregular network of chords or struts is particularly suited for filling an enclosing irregular or unusual spaces. The invention is applied in geodesic type domes and spatial enclosures, window enclosures and kiosques.

21 Claims, 16 Drawing Figures

UNIVERSAL HUB FOR GEODESIC TYPE STRUCTURES

TECHNICAL FIELD

This invention relates to a new hub providing a flexible or universal coupling for securing struts at the vertices of a geodesic type grid or framework. The invention also relates to an improved geodesic type spatial framework incorporating the new hubs and is useful for enclosing spaces with a custom grid of dissimilar triangle patterns.

BACKGROUND ART

Traditional geodesic domes and structures are based on the pioneering work of R. Buckminster Fuller described in his basic U.S. Pat. No. 2,682,235. The traditional geodesic dome or structure comprises a grid of intersecting members which generally follow the lines of great circles or arcs of a sphere. Such lines are referred to as geodesic lines. The intersecting members form patterns of triangles which impart rigidity and structural integrity to the grid. The equilateral triangles of the pattern are congruent, or if different pattern triangles are incorporated in the grid, the number of different patterns is minimized. The conventional geodesic contruction uses the least number of repeated triangle shapes or patterns in order to minimize the mathematical complexity and consequent manufacturing complexity, retooling and expense.

The intersections where a plurality of struts or chords converge in a geodesic grid are referred to as vertices or nodes. According to conventional geodesic construction, the chords or struts are rigidly connected at the intersections. A variety of rigid hubs, joints, and connections have been used and are described in the literature. For example, fixed hubs for geodesic structures are shown in FIGS. 4 through 7 of U.S. Pat. No. 3,461,635. Rigid connecting devices for the vertices of spherical structures are also illustrated in U.S. Pat. No. 3,785,101, for example, FIG. 5. The *Dome Builders Handbook* in two editions published by Running Press, 38 South 19th Street, Philadelphia, PA 19103 describes a variety of rigid hubs and plates. Chapter 4 of the *Geodesic Greenhouse* published by Garden Way, Charlotte, VT 05445 is directed to rigid base hubs, pent hubs and hex hubs. Edmund Scientific of Barrington, N.J. offers the "Star Plate" rigid hub or joint for securing the vertices in geodesic structures, for example, "Star Plate", Serial No. K31,947 shown in the Edmund Scientific 1982 Fall Catalog.

The use of rigid hubs, joints and connections at the vertices or nodes of traditional geodesic structures is a consequence of the commitment to mathematical or geometrical regularity. The minimum number of equilateral triangle patterns, in turn minimizes the number of different central angles, axial angles and chord factors so that the same type of hubs may be repeated and fixed throughout the structure. Thus, the rigid hubs are particularly adapted to conventional construction methods where the same vertex configuration is repeated throughout the framework.

A disadvantage of the conventional methods, however, is that there is no flexibility in the structure particularly for closing or filling irregular spaces. The conventional method of construction is not well adapted to custom fitting and custom construction on site. There is no flexibility for adjusting the central converging angles of struts converging at a vertex of the grid, for adjustment of chordfactors to provide an irregular network of chords or struts in triangle patterns, and for adjustment of the depth of articulation of the struts at the vertices and the consequent dihedral angles of the triangle patterns relative each other. Furthermore, contrary to what might be initially assumed, the strict adherence to the pure mathematical and geometrical geodesic construction may be to the detriment of aesthetic considerations caused, for example, by the distortion or degradation of aesthetic lines.

OBJECTS OF THE INVENTION

It is therefore an object of the present invention to provide a new articulating universal hub for flexibly joining and securing the struts at the vertices or nodes where a plurality of struts converge in a geodesic type spatial framework.

Another object of the invention is to provide a universal hub for the vertices of geodesic type grids which permits variable converging angles for the chords converging at the vertex of the grid, variable articulation of the angles of the struts, and variation in the depth of the apex of each vertex from a plane underlying the vertex.

Another primary purpose of the invention is to provide a new geodesic type spatial framework incorporating the universal hubs, which framework affords the advantages of geodesic construction but departs from the requirements of mathematical and geometrical regularity.

A further object of the invention is to provide a new geodesic type spatial framework or grid of triangle patterns in which all the triangles may differ, and which is suited for filling and enclosing irregular spaces. Thus, the invention seeks to provide a geodesic type construction system adapted for custom fitting and on site customized enclosure of irregular spaces.

DISCLOSURE OF THE INVENTION

In order to accomplish these results the invention provides a new universal hub formed by a plurality of universal connectors, each connector having a pair of hinge faces. The hinge faces or plates are positioned on the facing side surfaces of adjacent chords converging at a vertex of a geodesic type spatial framework. Each hinge face is secured in parallel at the side surface of the corresponding strut at a single pivot point for rotation of the hinge face relative to the side surface of the strut during construction. The universal connectors are further formed with hinge ears extending or depending from the sides of each hinge face for defining a hinge axis offset from the plane of the corresponding hinge face. Hinge ears from adjacent hinge faces of a universal connector overlap and coincide to define a common hinge axis between the respective hinge faces or plates and offset from the planes of each. The universal connector hinge faces or plates may therefore rotate in a first degree of freedom around the hinge axis and in second and third degrees of freedom about the pivot point securing the hinge faces or plates at the facing side surfaces of adjacent struts.

The invention also contemplates that universal connectors securing adjacent pairs of converging struts form a closed ring of universal connectors and converging struts at each vertex of the geodesic type spatial framework. A feature and advantage of this configuration of the present invention is that the universal connectors and converging struts or chords form a universal hub at each vertex of the geodesic type spatial framework in which the converging angles between adjacent struts may differ and may be varied. Furthermore, the depth of the apex of the vertex from an underlying plane may be varied by varying the articulation angles of the struts relative to a plane.

Another aspect of the invention provides a geodesic type spatial framework of intersecting struts or chords arranged in a grid of a plurality of triangle patterns with struts converging at vertices or nodes of the grid. The universal hubs according to the invention are incorporated at the vertices of the geodesic type spatial framework. A feature and advantage of this arrangement is that a space may be custom fitted and enclosed with chords of variable length, variable converging angles relative to each other at the vertices, and variable articulation angles at the vertices, for forming a plurality of different irregular triangles by universal rotation of the universal connectors. The universal action of the connectors is achieved by rotation of hinge faces about the hinge axes and rotation of hinge faces or plates relative to side surfaces of the struts.

According to other aspects of the invention, the universal connectors are constructed and arranged so that there is no interference by the hinge plates with any inner or outer skin affixed to the inside or outside edges of the respective struts for any operative angular position of the universal connectors. Thus, the hinge plates lie within the inner and outer edges of the respective struts for each operative rotational position. The universal connectors may also be varied in spacing from the ends of the struts for extending the struts substantially beyond the vertex to form, for example, a roof rafter strut. In another embodiment of the invention the universal connectors are formed on sleeves arranged for frictional fitting over the ends of the struts converging at a vertex of the geodesic type spatial framework. Alternatively, the struts or chords may comprise extruded hollow tubular members with hinge plates pivotally secured to each side surface at a pivot point for rotation relative to the strut. Interfitting tracks may be formed on the inner and outer edges of the extruded hollow tubular member for securing an inner and outer skin to the framework.

In various embodiments of the geodesic type spatial framework, the grid of triangle patterns may comprise hexagonal vertices, pentagonal vertices, rectangular vertices, etc. with universal hubs comprising hexagonal rings, pentagonal rings, rectangles, etc. A novel kiosque is described having a hexagonal roof and base with pentagonal universal hubs at the intersections of the roof and walls. A number of embodiments are disclosed of the geodesic type spatial framework of the present invention departing from the strictly mathematical and geometric traditional geodesic construction in providing patterns of dissimilar triangles for custom fitting or enclosing irregular spaces. A feature and advantage of the invention is that it can provide a geodesic type spatial framework of an irregular network of lines, chords or struts for filling and enclosing any space

BRIEF FIGURE DESCRIPTIONS

Figure 5:
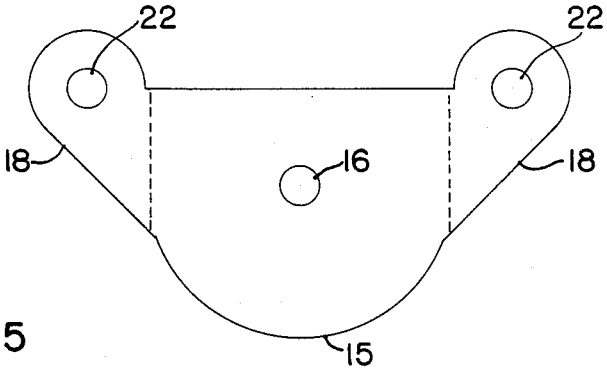
FIG. 5 is the plan view of a blank hinge plate or face, before folding of the respective hinge ears at a 90° angle for defining the hinge axis offset from the plane of the hinge face.
Figure 5A:
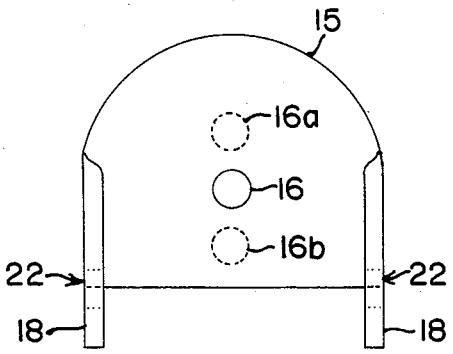
Figure 5B:
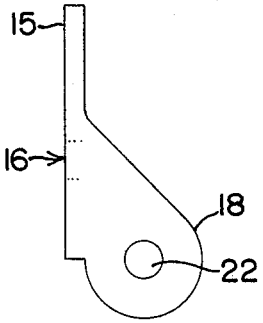
Figure 5C:
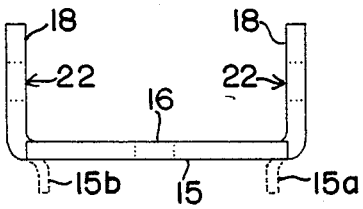

FIGS. 5A, 5B, and 5C are a plan view, side view, and end view respectively of the hinge plate or face with hinge ears folded to operative position at right angles relative to the hinge face plane.

Figure 6:
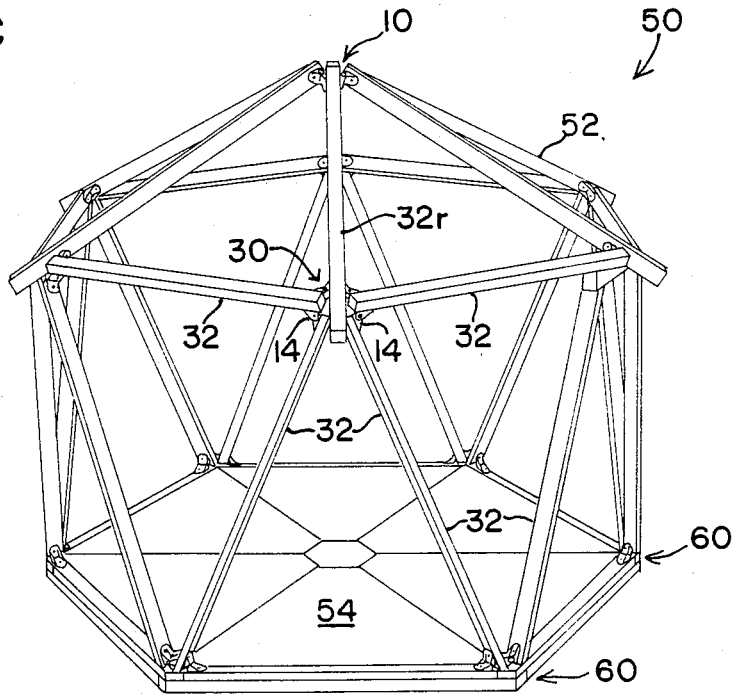

FIG. 6 is a perspective view of a geodesic type spatial framework incorporating hexagonal vertex, pentagonal vertex, and base universal hubs according to the invention.

Figure 7:
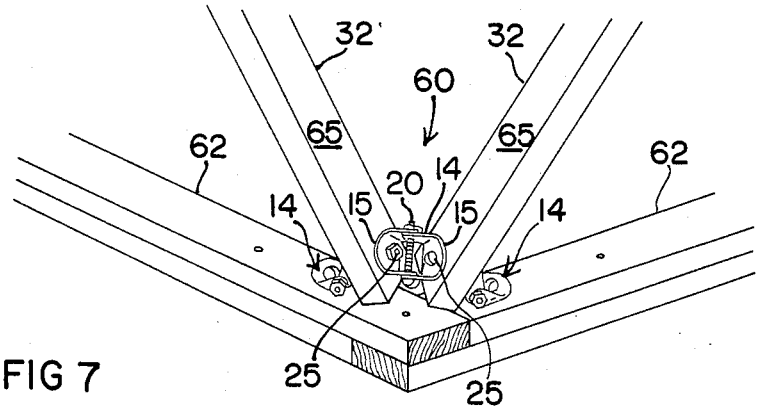

FIG. 7 is a fragmentary detailed perspective view of the base universal hub incorporated in the geodesic type spatial framework of FIG. 6.

Figure 8:
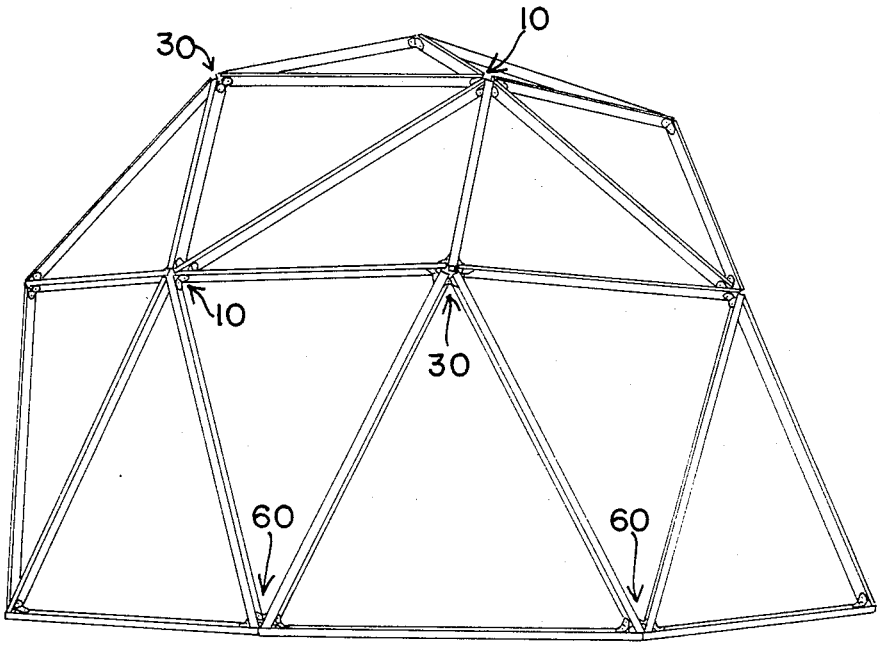

FIG. 8 is a perspective view of a geodesic type spatial framework according to the invention comprising a grid of a pattern of dissimilar triangles with alternating hexagonal and pentagonal vertices lying approximately on a section of the surface of a sphere.

Figure 10:
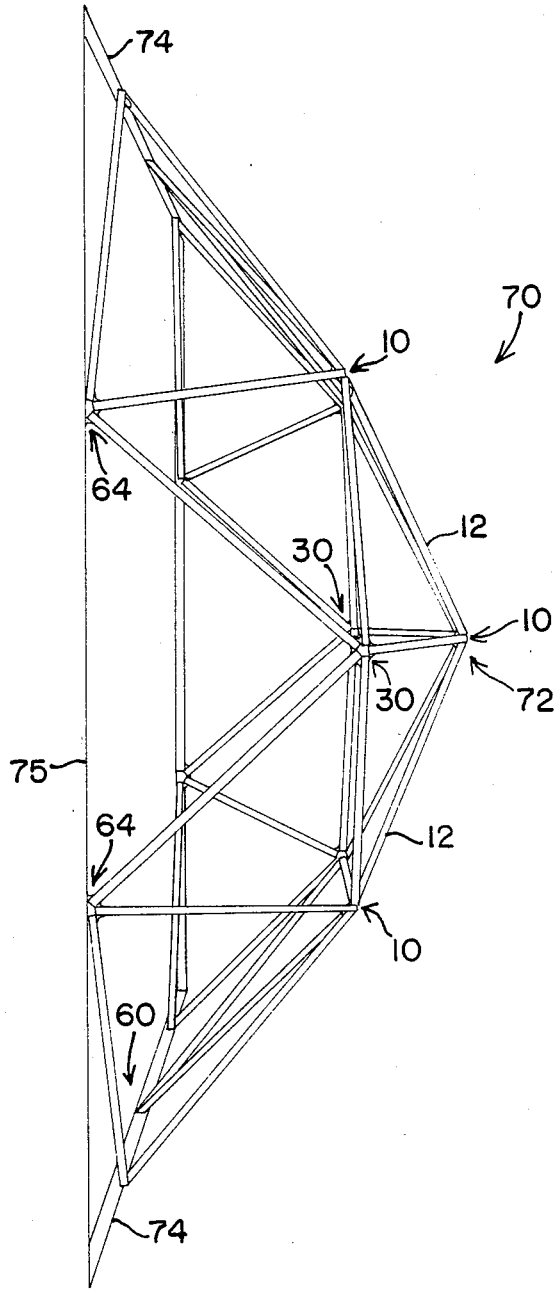

FIG. 10 is a perspective view from the side of a geodesic type spatial framework according to the present invention comprising a grid of irregular or dissimilar triangles also viewed as an irregular network of lines or struts for filling or enclosing a window space.

Figure 9:
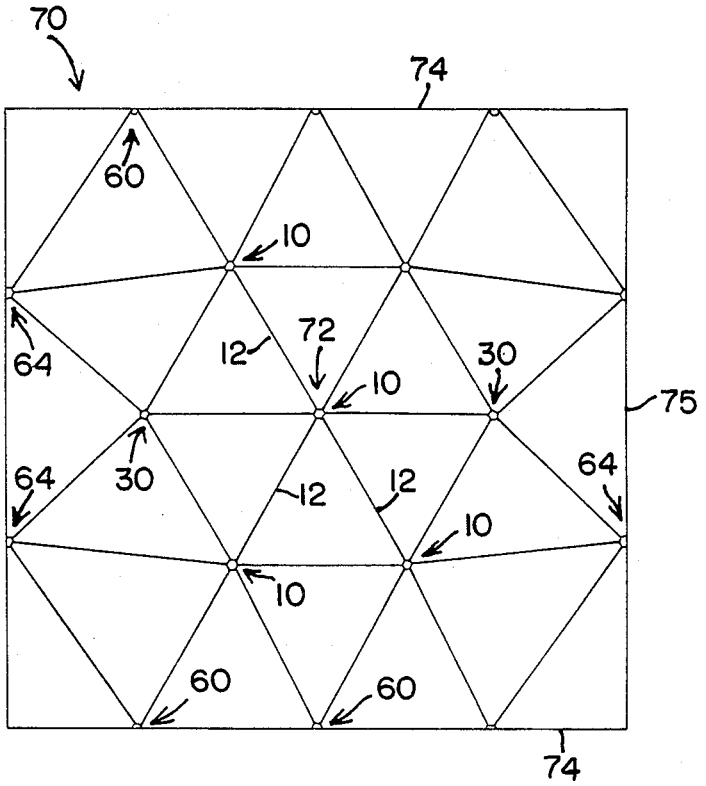

FIG. 9 is a plan view of the window enclosing geodesic type spatial framework of FIG. 10.

Figure 11:
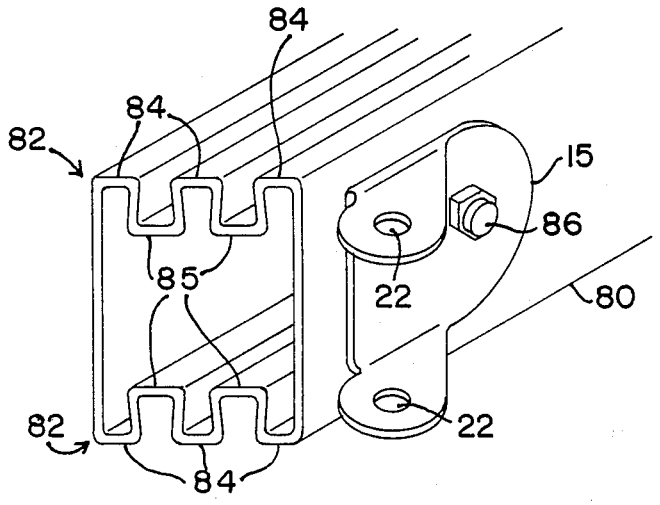

FIG. 11 is a fragmentary perspective view of the end of an extruded strut according to the present invention showing a hinge plate pivotally mounted on a side of the strut.

Figure 12:
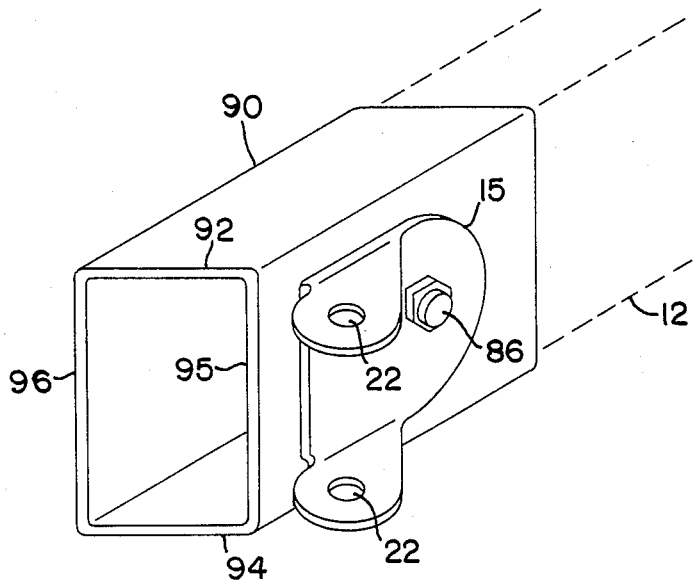

FIG. 12 is a perspective view of a universal connector sleeve according to the invention for frictionally fitting over the end of a strut and pivotally mounting a hinge plate at the side of the strut.

DESCRIPTION OF PREFERRED EXAMPLE EMBODIMENTS AND BEST MODE OF THE INVENTION

Figure 1:
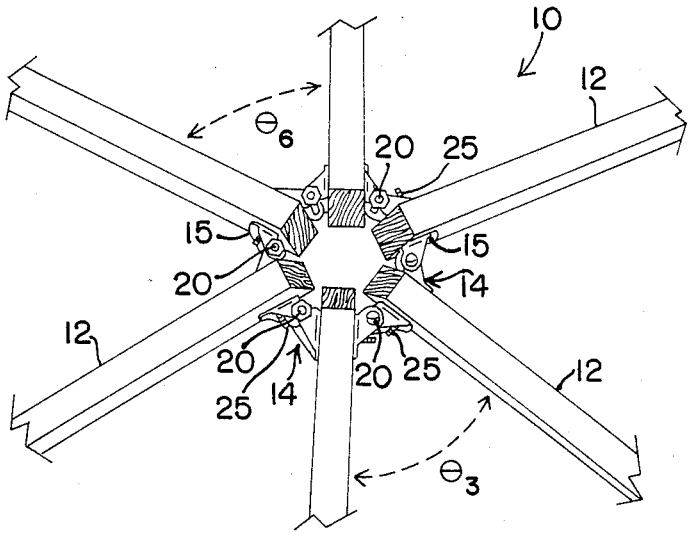
FIG. 1 is a fragmentary plan view in perspective of an hexagonal ring universal hub according to the present invention at the vertex of six converging struts in a geodesic type spatial framework.

A universal hub 10 according to the present invention is shown in FIG. 1 at the vertex of six converging struts 12. The universal hub or coupling 10 is in the form of an hexagonal ring of universal connectors 14 joining the struts at adjacent facing sides near the converging ends of the struts. The hub and vertex illustrated in FIG. 1 may be viewed as part of a larger geodesic type spatial framework. The universal connectors 14 and struts 12 comprising the universal hub or coupling cooperate as hereafter described.

Figure 4A:
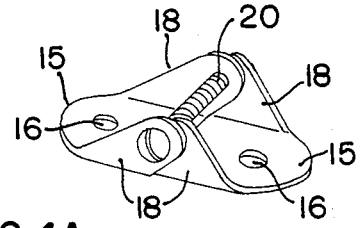
FIG. 4A is a perspective view of a universal connector according to the present invention with the hinge plates or faces fully extended or open to a 180° position.
Figure 4B:
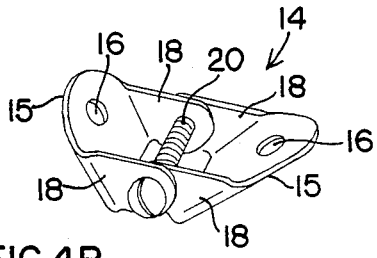
FIG. 4B is perspective view of another universal connector with the hinge plates or faces in an operative rotational position relative to each other for universally joining, for example, two converging struts.

Referring to FIGS. 4A and 4B, each universal connector 14 comprises a pair of hinge faces or plates 15 which are positioned at the facing side surfaces of adjacent chords or struts 12 converging at a vertex. Each hinge plate or face 15 is secured in parallel at the side surface of the strut at a single pivot point 16 for rotation of the hinge plate relative to the side surface of the strut during placement and orientation of struts in the geodesic type spatial framework. Each hinge plate or face 15 is formed with a pair of hinge ears or tabs 18 extending at right angles from the sides of the plate 15 to define a hinge axis 20 offset from the plane of the corresponding hinge face 15. It is apparent that the hinge ears 18 from adjacent hinge faces 15 of a universal connector 14 overlap and coincide to define a common hinge axis 20 between the respective hinge faces. The common hinge axis 20 is offset from the planes of both respective hinge plates of the pair comprising the universal connector.

The hinge plates or faces 15 of each universal connector 14 may rotate or pivot relative to each other in a first degree of freedom around the hinge axis 20 and in second degrees of freedom about the pivot points 16 securing the hinge faces 15 at the facing side surfaces of adjacent struts. It is apparent that each universal connector forms a universal joint between adjacent struts converging at a vertex. The universal hub 10, for example as shown in FIG. 1, therefore comprises a plurality of universal joints arranged in a ring between the adjacent struts converging at the vertex. Universal hub 10 is truly a compound universal joint or coupling.

Referring again to FIG. 1, the hinge plates 15 on opposite sides of a strut 12 are joined to the strut by a common pivot bolt 25 passing through the strut and the pivot holes 16 formed in each hinge plate 12 not visible in FIG. 1 but shown in FIG. 4B. During construction of a hub at the vertex of the geodesic type spatial framework, the common pivot bolts 25 may be placed without final tightening so that the hinge plates 15 may rotate or pivot in parallel with the side facing surface of the respective strut for optimum positioning. Thus, during enclosure of a space, the hub may be maintained in a flexible state until final positioning.

In this flexible condition the converging angles between the struts 12 may be set in desired angular relationships. As used herein, the phrase "converging angle" and "central angle" refer to the angle $\theta$ between adjacent converging struts in the plane of the paper. According to the present invention, each converging angle between adjacent struts may differ at any particular hub or vertex. Thus, angle $\theta_3$ may differ from angle $\theta_6$. Similarly, the articulating angles of the struts may also be varied while the hub 10 is maintained in its flexible state. As used herein, the articulating angle of a strut 12 with reference to FIG. 1 is intended to mean an angle subtended by the strut 12 and a plane underlying the vertex of hub 10 and measured in a direction perpendicular to the plane of the paper. Thus, the articulating angles of the struts 12 provide a measure of the steepness or height of the apex of the vertex illustrated in FIG. 1 relative to an underlying plane parallel to the plane of the paper. Variation in the converging angle $\theta$ between adjacent chords 12 is effected by rotation of the opposing hinge plates 15 relative to each other around the common hinge axis 20 while variation in the articulating angles may involve rotation not only about the common hinge axis 20, but also rotation of the hinge plates 15 relative to the side surfaces of chords 12.

Figure 2:
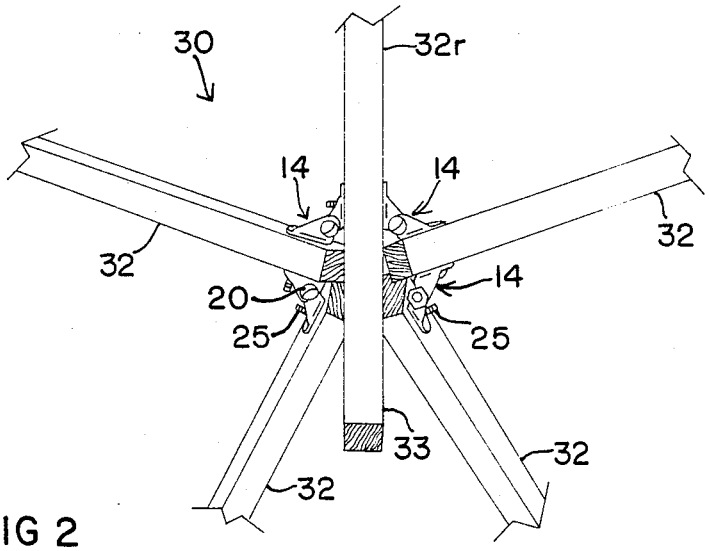
FIG. 2 is a fragmentary plan view and perspective of a pentagonal ring universal hub at the vertex of five converging struts in which a roof a roof rafter strut extends beyond the vertex.

Another universal hub at a pentagonal vertex is illustrated in FIG. 2. The pentagonal ring universal hub 30 comprises the universal connectors 14 joining the converging ends of five converging struts 32 at the vertex of a geodesic type spatial framework. In the example of FIG. 2, one of the struts 32R extends considerably beyond the hub and vertex forming a roof rafter strut with an overhang 33. The universal connectors 14 operate in the manner described with reference to FIG. 1. The universal connectors 14 secured to the roof rafter strut 32R, however, are secured to the opposing sides of the strut at a location spaced from the end of the strut equal to the length of the overhang 33. In this manner the universal hub 30 is applicable for use at the junction of the roof and wall of a geodesic type spatial framework of the type, for example, illustrated in FIG. 6 where corresponding elements are designated with the same reference numerals.

Figure 3:
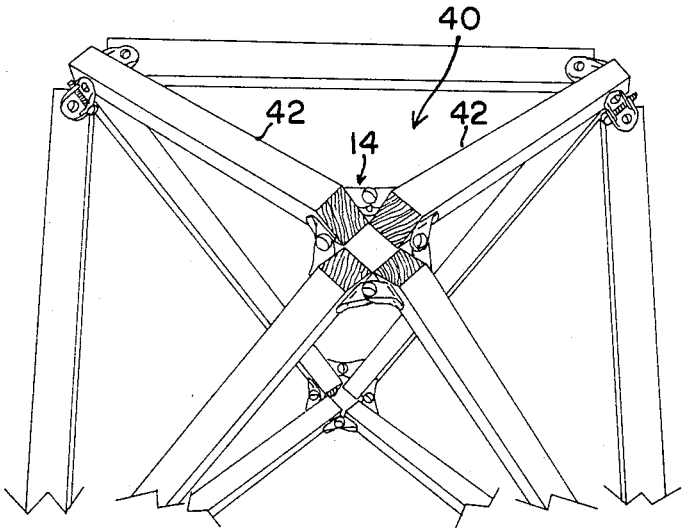
FIG. 3 is a fragmentary perspective view of a geodesic type spatial framework showing the detail of a rectangular or square universal hub at the vertex of four converging struts.

Yet another example of the universal hub is illustrated in FIG. 3 at the vertex of 4 converging struts. The rectangular ring universal hub 40 comprises a rectangle of 4 universal connectors joining the adjacent converging struts 42 in the manner described with reference to FIGS. 1 and 2. In the example of FIG. 3, the rectangle universal hubs or couplings are shown in the context of an octahedral spatial framework with similar rectangle universal hubs or couplings at the other vertices of the framework.

Referring to FIG. 5, each hinge plate or face 15 of a universal connector may be, for example, punched or cut as a flat blank with the ears 18 lying in the same plane as the hinge face or plate 15. The pivot hole 16 is formed in the hinge plate 15 to provide the pivot point for rotation of hinge face 15 relative to the side of a chord 12. At the same time the hinge axis holes 22 may be punched in ears 18 for defining the hinge axis 20 to be offset from the plane of hinge plate 15. As shown in FIGS. 5A, 5B, and 5C, the hinge ears 18 are then folded at right angles relative to the hinge face or plate 15 to form one of the elements of the universal connector. The ears or tabs 18 are skewed or tapered relative to the hinge plate 15 so that the common axis 20 defined by hinge axis holes 22 is offset to the side of hinge plate 15 that is to the side of the center of hinge plate 15 and pivot hole 16. Thus, the common hinge axis 20 is offset not only from the planes of the respective hinge plates 15, but also from the pivot points 16 at which the hinge plates 15 are secured at the sides of the struts. By this expedient of offset in two dimensions the universal joint action of each universal connector 14 is enhanced.

As shown in FIG. 5A, the hinge plate or hinge face 15 may be formed with optional pivot point holes, for example, 16A and 16B in addition to the basic pivot point hole 16. The basic pivot point for hinge face plate 15 may be selected at either of the optional pivot point holes according to the degree of offset desired for the connector. The hinge plates are secured on opposite sides of the converging end of a chord by a single bolt 25 passing through the selected pivot point holes on either side. After final seating of the universal connector, the optional holes may be used for further tacking or securing the hinge plate to the side surface of the chord for increased rigidity and strength at the universal hub. Alternately, the hinge face plate 15 may be formed with teeth or rows of teeth 15A and 15B as shown in FIG. 5C. During initial placement of a universal connector formed with such hinges, the projecting teeth 15A and 15B would not be buried in the wood surface of the strut so that the hinge plate 15 would be free to rotate to its final seating position. At that time the teeth are imbedded in the wood of the side surface of the chord in order to increase the strength of the universal hubs and geodesic type framework by spreading out the area of bearing force application of the hinge plate against the surface of the chord or strut.

A geodesic type structure according to the present invention is illustrated in FIG. 6. The geodesic type framework 50 may be of small dimensions and serve, for example, as a kiosque or be scaled up in dimensions for a larger enclosure. The kiosque 50 is formed with an hexagonal roof frame 52 of six triangles and a hexagonal base 54. The roof rafters are joined at the apex by a hexagonal ring universal hub 10 of the type illustrated in FIG. 1. The side walls comprise a pattern of twelve triangles joined at the top to the roof rafters by pentagonal ring universal hubs 30 of the type illustrated in FIG. 2 and corresponding elements are indicated by similar reference numerals. The base universal hubs 60 are illustrated in greater detail in FIG. 7.

As shown in FIG. 7, the wall struts 32 converge at the bottom plates or beams 62 and are joined relative to each other by a universal connector 14 of the type illustrated in FIG. 4B. In order to accommodate the converging angle between the wall struts 32, and the articulating angles of the wall struts 32 relative to an imaginary plane underlying the base vertex of hub 60, the universal connector 14 is rotated in three degrees of freedom until the hinge plates 15 are parallel and flush with the side facing surfaces 65 of wall struts 32. The hinge faces 15 pivot or rotate on the side facing surfaces 65 around the respective bolts 25 which pass through the struts 32 and the pivot holes or pivot points 16 formed in the hinge faces 15 as heretofore described. The hinge plates 15 of universal connector 14 of course rotate relative to each other around the common hinge axis bolt 20.

Similarly, the universal connectors 14 between wall struts 32 and the base struts or beams 62 must also be universally adjusted to accommodate the converging and articulating angles of the respective adjacent struts.

Application of the present invention for enclosing a section of a surface of a sphere with an irregular network of struts is illustrated in FIG. 8. In this embodiment of the invention an enclosure is constructed resembling a section of a geodesic dome with a grid of triangles arranged in patterns of overlapping hexagons and pentagons. As shown in FIG. 8, each hexagon pattern is formed at its central converging vertex with a universal hub 10 of the type illustrated in FIG. 1. Each pentagon pattern of triangles is formed at its central vertex with a universal hub 30 of the type illustrated in FIG. 2 but of course without the overlapping roof strut. Base universal hubs 60 of the type illustrated in FIG. 7 are provided around the base of the enclosure. The geodesic type arrangement of struts illustrated in FIG. 8 therefore bears close resemblance to the geodesic dome of Fuller with triangles arranged in overlapping patterns of hexagonal "sixes" and pentagonal "fives". However, the geodesic type spatial framework of the present invention departs from the matematical and geometrical purity of the traditional Fuller dome in that all of the struts may differ in length and all of the converging central angles of the struts may also differ. Thus, the enclosure of the present invention may be custom constructed to enclose an irregular space or to conform to desired lines so that every universal hub 10, every universal hub 30 and every universal hub 60 may differ with respect to each other in chord factors, converging angles and articulating angles without the necessity of conforming to rigid geometrical or mathematical specifications and rigid preformed hubs. The present invention therefore affords dramatically greater flexiblity and ease of construction at any particular site location by initial fabrication of the universal hubs in a flexible state prior to the final stiffening or rigidifying as hereafter described.

A novel application of the geodesic type framework is shown in the window space enclosure of FIGS. 9 and 10. This window frame or enclosure 70 particularly highlights the features and advantages of the geodesic type spatial framework of the present invention. The framework 70 is clearly viewed as an irregular network of struts or chords designed to achieve aesthetic objectives without regard to the geometrical or mathematical "purity" or requirements of traditional geodesic grids or structures. The framework 70 comprises a grid of triangle patterns which are highly irregular or dissimilar from each other and are selected to achieve the desired aesthetic appearance or other aesthetic objectives. The apex 72 of the window frame is a vertex of six converging chords or struts 12 with a universal hub 10 of the type illustrate in FIG. 1 incorporated at the apex adjacent to the ends of the converging struts. The hubs converge above and below at further vertices with hexagonal ring universal hubs according to the present invention. On either side the chords converge at pentagonal vertices where five struts converge with pentagonal ring universal hubs 30 at the converging ends of the struts, without of course, overlapping roof rafter strut. Around the rectangular edges 74 of the frame the struts converge at base universal hubs 60 of the type heretofore described with reference, for example, to FIG. 7. Although further variations are shown at the sides with the addition of an extra strut. Thus, the side base universal hubs 64 at the side edges 75 of the rectangular frame comprise three struts of the grid converging at the base struts or chords 75.

In filling a non-spherical or unusual space with the framework of the present invention, the central and converging angles at the nodes or vertices of the framework need not be calculated in advance. According to the method of the present invention, only the lengths of the chords or struts and the locations of the vertices are determined in advance. Thus, the space may be filled with a grid or network of lines according to the desired aesthetic experience thereby determining the location of intersections or vertices of the converging lines of the network. The lengths of the chords or struts may then be measured graphically in advance. All of the angles may actually differ, and every triangle pattern in the geodesic type grid may be different. Thus, the lines of the pattern grid and framework of the present invention do not necessarily follow the proper geodesic lines of traditional Fullerian geodesic dome construction. Rather, the lines of the framework conform to the aesthetic choices of the designer. There is no necessity for geometrical or mathematical similarity of pattern triangles nor any requirement to conform to strict geodesic lines as such. However, the framework incorporates all of the advantages of structural integrity and strength afforded by the grid of triangles in geodesic construction. The framework structures of the present invention are therefore referred to as geodesic type frameworks and that they afford all the advantages of a triangulated grid but without the disadvantages of conforming to rigid mathematical or geometrical dimensions. Rather, the framework of the present invention incorporating the novel universal hubs lends itself to flexible design and custom construction for achieving desired aesthetic pattern or appearance.

The structural members and universal couplings of the present invention may assume a variety of configurations as, for example, illustrated in FIG. 11. In the embodiment of the invention shown in FIG. 11, the struts are manufactured as extruded hollow tubes of aluminum or hollow aluminum beams 80 with tracks 82 comprising lands 84 and grooves 85 formed at the inner and outer edges of groove 80 for accommodating, tracking and securing either or both an inner and outer skin, sheath, wall or covering. The hinge plate 15 forming one half of a universal connector 14 is secured at the facing side of strut 80 at a single pivot point formed by the bolt 86 which passes through only one side of the strut 80. The hinge plate 15 is of course hingedly mounted to an adjacent hinge plate 15 not shown, on an adjacent converging chord not shown by a common hinge axis bolt or pin passing through the hinge ear holes 22. A feature and advantage of this construction according to the present invention is that the hinge plate 15 does not interfere with a skin, sheath, or covering mounted at either the inner or outer edge of the strut 80. The width of the side faces of strut 80 may vary and of course may be widened to accommodate the hinge plates 15 at any operative rotational position without interference with any skin, sheath or covering mounted on the inner or outer edges of the struts 80.

Yet another embodiment of the invention is illustrated in FIG. 12 where the hinge plate 15 of the universal connector 14 is pivotally mounted by rivot or bolt 86 to the side face of a sleeve 90 having inner and outer walls 92 and 94, and side walls 95 and 96 constructed or molded for frictional fitting over the end of a strut 12. The sleeve 90 may be open ended or may be formed with a cap or closure at one end. An advantage of the construction as shown in FIG. 12 is that the sleeve may be adjusted along the length of the end of strut 12 for varying the position of the universal connector relative to the end of the strut. Thus, the strut 12 may extend through the sleeve 90 to extend substantially beyond a vertex and function as a roof rafter strut with overhang.

While the invention has been described with reference to particular example embodiments, it is intended to cover all variations and equivalents within the scope of the following claims.

I claim:

1. A new hub structure for securing struts at the vertices or nodes where a plurality of struts converge in a geodesic type spatial framework, said struts having inner and outer edges with reference to the spatial enclosure and side surfaces facing each other comprising:

a plurality of universal connectors, each connector comprising a pair of hinge faces, said hinge faces positioned on the facing side surfaces of adjacent chords converging at a vertex of the geodesic type spatial framework, each hinge face secured in parallel at the side surface of the corresponding strut at a single pivot point for rotation of the hinge face relative to the side surface of the strut during placement and orientation of struts in the geodesic type spatial framework, said universal connectors further comprising hinge ears extending from the sides of each hinge face for defining a hinge axis offset from the plane of the corresponding hinge face, said hinge ears from adjacent hinge faces of a universal connector overlapping and coinciding to define a common hinge axis between the respective hinge faces and offset from the planes of the respective hinge faces whereby said universal connectors may rotate in a first degree of freedom around the hinge axis and in second and third degrees of freedom about the pivot points securing said hinge faces at the facing side surfaces of adjacent struts whereby each said universal connector comprises a universal joint between adjacent struts converging at a vertex of the geodesic type spatial framework;

said plurality of universal connectors securing adjacent pairs of converging struts at the side surfaces facing each other to form a closed ring of universal connectors and converging struts at each vertex of the geodesic type spatial framework, said closed ring of universal connectors and converging struts forming a universal hub at each vertex of the geodesic type spatial framework in which the converging angles between adjacent struts may differ and may be varied and whereby the depth of the apex of the vertex from an underlying plane may be varied by the articulation angles of the struts relative to a plane;

said universal hub at each vertex of the geodesic type spatial framework thereby permitting the enclosure of a space with chords of variable length, variable converging angles relative to each other, and variable articulation angles, for forming a plurality of different irregular triangles in the geodesic type spatial framework by pivoting of hinge faces about the hinge axes and rotation of hinge faces relative to side surfaces of the struts;

said universal connectors further variable in the spacing of the respective hinge faces from the ends of the struts for varying the spacing of the ends of the struts relative to each other and for extending a strut substantially beyond the vertex if desired;

said hinge faces of the universal connectors and said side surfaces of the respective struts being constructed and arranged so that the hinge faces lie within the inner and outer edges of the respective struts for each operative rotational position of the universal connectors relative to the facing side surfaces of adjacent struts so that there is no interference by the universal connectors and universal hub with any inner or outer skin affixed to the inside or outside edges of the respective struts for any operative angular position of the universal connectors thereby permitting enclosure of irregular or odd spaces with a geodesic type spatial framework.

2. The hub structure of claim 1 further comprising a plurality of universal connector sleeves constructed and arranged for frictional fitting over the ends of struts converging at a vertex of the spatial framework, each sleeve formed with inner and outer walls and side walls conforming to the inner and outer edges and side surfaces of the respective struts, said sleeves further formed with said hinge faces bearing against the side walls of said sleeves and secured at least at one pivot point for rotation of the hinge faces relative to the side walls, said sleeves fitted over the ends of struts converging at a vertex so that the hinge ears extending from hinge faces pivotally secured to side walls on facing side surfaces of adjacent struts coincide to form said common hinge axis thereby defining the universal connector between each pair of struts converging at a vertex.

3. The hub structure of claim 1 wherein each converging strut comprises an extruded hollow tubular member with inside and outside edges and sidewalls having side surfaces, and wherein a hinge face is pivotally secured to each side surface at a pivot point for rotation relative to the tubular side surface, the hinge ears at the facing side surfaces of adjacent struts coinciding to define the pivot axis between adjacent struts converging at a vertex of the geodesic type framework.

4. The hub structure of claim 3 wherein the outside edge of said hollow tubular strut is formed with interfitting track means for securing an outer skin to said outer edges and without interference with a hinge face of a universal connector for any rotational position of said hinge face.

5. The hub structure of claim 1 in which one of the struts converging at a vertex of a geodesic type spatial framework comprises a roof rafter and wherein said roof rafter strut extends beyond the vertex and wherein the hinge faces of universal connectors bearing against the side surfaces of said roof rafter strut are spaced from the end of said strut a distance equal to the overlap of said roof rafter strut extending beyond the vertex.

6. The hub structure of claim 1 wherein said hinge axis comprises a removable and replaceable pivot pin for assembling and disassembling the universal hub in modular form while the hinge faces remain secured to the side surfaces of the struts comprising the geodesic type spatial framework.

7. The hub structure of claim 2 wherein each hinge axis comprises a removable and replaceable pivot pin for assembly and disassembly of the universal hub in modular form while the hinge faces remain secured to the universal connector sleeves.

8. The hub structure of claim 1 further comprising means for securing the hinge faces to the side surfaces of respective struts at locations in addition to the respective pivot points to increase the strength of the hub structure and for rigidly securing the hinge faces of the respective side surfaces of the struts upon orientation of the universal connectors to accommodate specified converging angles and articulation angles for the struts.

9. The hub structure of claim 8 wherein said means for securing the hinge faces at locations in addition to the pivot points comprise teeth for engaging the side surfaces of the struts.

10. The hub structure of claim 8 wherein said means for securing the hinge faces to respective side surfaces of the struts at locations in addition to the pivot points comprise tacking holes formed in the hinge faces spaced from said pivot points.

11. The hub structure of claim 1 wherein said hinge ears of each universal connector define a hinge axis offset to the side of said hinge faces spaced from said pivot points.

12. A new geodesic type spatial framework comprising:

a plurality of struts arranged in a grid of a plurality of triangle patterns with struts converging at vertices or nodes of the grid, said struts having inner and outer edges with reference to the spatial enclosure and side surfaces facing each other;

a plurality of universal connectors, each connector comprising a pair of hinge plates, said hinge plates positioned on the facing side surfaces of adjacent chords converging at the vertices of the grid of triangle patterns, each hinge plate secured in parallel at the side surface of the corresponding strut at a single pivot point for rotation of the hinge plate relative to the side surface of the strut during placement and orientation of struts in the grid of triangle patterns forming the geodesic type spatial framework, said universal connectors further comprising hinge ears extending from the sides of each hinge plate for defining a hinge axis offset from the plane of the corresponding hinge plate, said hinge ears from adjacent hinge plates of a universal connector overlapping and coinciding to define a common hinge axis between the respective hinge plates offset from the planes of the respective hinge plates whereby said universal connectors may rotate in a first degree of freedom about the hinge axis and in second and third degrees of freedom about the pivot points securing said hinge plates at the facing side surfaces of adjacent struts whereby each said universal connector comprises a universal joint between adjacent struts converging at a vertex of the grid of triangle patterns;

said plurality of universal connectors securing adjacent pairs of converging struts at the side surfaces facing each other to form a closed ring of universal connectors and converging struts at each vertex of the grid of triangle patterns, said closed rings of universal connectors and converging struts thereby forming universal hubs at the vertices of the grid of triangle patterns, said universal hubs comprising converging angles between adjacent struts which may differ and which may be varied, each universal hub further comprising an apex of the vertex whose depth may be varied from a plane by varying the articulation angles of the struts converging at the universal hub;

said universal hub at each vertex of the grid of triangle patterns thereby permitting the enclosure of a space with chords of variable length, variable converging angles relative to each other, and variable articulation angles, for forming a plurality of different irregular triangle patterns in the geodesic type spatial framework by pivoting of hinge plates about the hinge axes and rotation of hinge plates relative to side surfaces of the struts;

said universal connectors further variable in the spacing of the respective hinge plates from the ends of the struts for varying the spacing of the ends of the struts relative to each other and for extending the struts substantially beyond a vertex if desired;

said hinge plates of the universal connectors and said side surfaces of the respective struts being constructed and arranged so that the hinge plates lie within the inner and outer edges of the respective struts for each operative rotational position of the universal connectors relative to the facing side surfaces of adjacent struts so that there is no interference by the universal connectors and universal hub with any inner or outer skin affixed to the inside or outside of the geodesic type spatial framework on the inside or outside edges of the respective struts comprising the grid of triangle patterns for any operative angular position of the universal connectors thereby permitting enclosure of irregular or odd spaces by said geodesic type spatial framework and grid of triangle patterns.

13. The geodesic type spatial framework of claim 12 wherein said grid comprises irregular dissimilar triangle patterns.

14. The geodesic type spatial framework of claim 12 wherein each hinge plate is secured to the side surface of a respective strut at least at a second location spaced from said pivot point to increase the strength of the universal hubs and therefore the grid of triangle patterns.

15. The geodesic type spatial framework of claim 12 wherein the hinge axis of the plurality of universal connectors comprise removable and replaceable pivot pins for assembling and disassembling the geodesic type spatial framework in modular form while the hinge plates remain secured at the side surfaces of the struts comprising the geodesic type spatial framework.

16. The geodesic type spatial framework of claim 12 wherein at least some of said universal hubs comprise hexagonal rings securing six (6) struts converging at a vertex.

17. The geodesic type spatial framework of claim 12 wherein at least some of said universal hubs comprise pentagonal rings securing five struts converging at a vertex of the grid of triangular patterns.

18. The geodesic type spatial framework of claim 17 wherein one strut in the universal hubs comprising pentagonal rings comprises a roof rafter strut extending beyond the vertex and wherein the hinge plates of universal connectors bearing against the side surfaces of said roof rafter strut are spaced from the end of said strut a distance equal to the overlap of said roof rafter strut extending beyond the vertex.

19. The geodesic type spatial framework of claim 18 wherein said framework comprises a kiosque comprising a roof in the form of a grid of six triangles with a vertex of six converging struts at the apex of the roof, and walls in the form of a grid of twelve triangles and further comprising a hexagonal base, said walls supporting the hexagonal roof on said hexagonal base, and wherein the vertices at the junction of the roof and walls comprise said pentagonal ring universal hubs.

20. The geodesic type spatial framework of claim 12 wherein said framework comprises a window enclosure of a grid of irregular dissimilar triangles.

21. The geodesic type spatial framework of claim 12 wherein said framework comprises a grid of a plurality of irregular triangle patterns arranged substantially in the configuration of a section of the surface of a sphere.

* * * * *